US012584246B2

(12) United States Patent
Kanemori et al.

(10) Patent No.: US 12,584,246 B2
(45) Date of Patent: Mar. 24, 2026

(54) METHOD FOR PRODUCING COMPOSITE FIBER AND COMPOSITE SPINNERET

(71) Applicant: Toray Industries, Inc., Tokyo (JP)

(72) Inventors: Yasunori Kanemori, Otsu (JP); Moeka Hirakawa, Otsu (JP); Joji Funakoshi, Otsu (JP)

(73) Assignee: Toray Industries, Inc., Tokyo (JP)

( * ) Notice: Subject to any disclaimer, the term of this patent is extended or adjusted under 35 U.S.C. 154(b) by 83 days.

(21) Appl. No.: 18/838,142

(22) PCT Filed: Feb. 21, 2023

(86) PCT No.: PCT/JP2023/006171
§ 371 (c)(1),
(2) Date: Aug. 13, 2024

(87) PCT Pub. No.: WO2023/171363
PCT Pub. Date: Sep. 14, 2023

(65) Prior Publication Data

US 2025/0146184 A1 May 8, 2025

(30) Foreign Application Priority Data

Mar. 11, 2022 (JP) ..... 2022-037754

(51) Int. Cl.
*D01D 5/36* (2006.01)
*D01D 4/02* (2006.01)
*D01D 5/088* (2006.01)

(52) U.S. Cl.
CPC ..... *D01D 5/36* (2013.01); *D01D 4/02* (2013.01); *D01D 5/088* (2013.01); *D10B 2331/04* (2013.01)

(58) Field of Classification Search
CPC ..... D01D 5/36; D01D 4/02; D01D 5/088; D01D 4/06; D01D 5/30; D01D 5/34; D10B 2331/04
(Continued)

(56) References Cited

U.S. PATENT DOCUMENTS 5,366,804 A * 11/1994 Dugan ..... D01F 8/14 525/425
5,405,698 A * 4/1995 Dugan ..... D01F 8/06 428/374
(Continued)

FOREIGN PATENT DOCUMENTS

EP 2660369 A1 11/2013
EP 2824225 A1 1/2015
(Continued)

OTHER PUBLICATIONS

Int'l Search Report (PCT/ISA/210) w/ translation & Written Opinion (PCT/ISA/237) mailed on Apr. 18, 2023, by the Japanese Patent Office in Int'l App. No. PCT/JP2023/006171. (9 pages).

*Primary Examiner* — Nahida Sultana
(74) *Attorney, Agent, or Firm* — Buchanan Ingersoll & Rooney PC

(57) ABSTRACT

A composite fiber is described that is capable of forming various fiber cross section shapes with high accuracy and maintaining high dimensional stability of a cross section shape. Also provided is a method for producing the composite fiber, the method comprising: distributing a sea-component polymer and at least one other-component polymer different from the sea-component polymer; discharging the sea-component polymer and the other-component polymer distributed by the distribution plate respectively from sea-component discharge holes and other-component discharge holes of a discharge plate positioned at a downstream side of the distribution plate with respect to a polymer
(Continued)

spinning path direction; and discharging the composite polymer from a discharge hole of a spinneret discharge plate positioned at a downstream side of the discharge plate with respect to the polymer spinning path direction.

5 Claims, 11 Drawing Sheets

(58) Field of Classification Search
USPC ..... 425/131.5, 133.1, 192 S, 463; 264/171.1
See application file for complete search history.

(56) References Cited

U.S. PATENT DOCUMENTS

| | | | | |
|---|---|---|---|---|
| 2014/0120336 | A1* | 5/2014 | Masuda | D01D 5/36 428/221 |
| 2018/0030622 | A1* | 2/2018 | Masuda | D03D 15/283 |
| 2023/0323569 | A1* | 10/2023 | Matsuura | D01D 5/24 428/373 |
| 2025/0084564 | A1* | 3/2025 | Hahm | D01F 8/06 |

FOREIGN PATENT DOCUMENTS

| | | | |
|---|---|---|---|
| JP | H04222205 | A | 8/1992 |
| JP | 2010203005 | A | 9/2010 |
| JP | 2011208313 | A | 10/2011 |
| WO | 2012090538 | A1 | 7/2012 |
| WO | 2013133056 | A1 | 9/2013 |

* cited by examiner

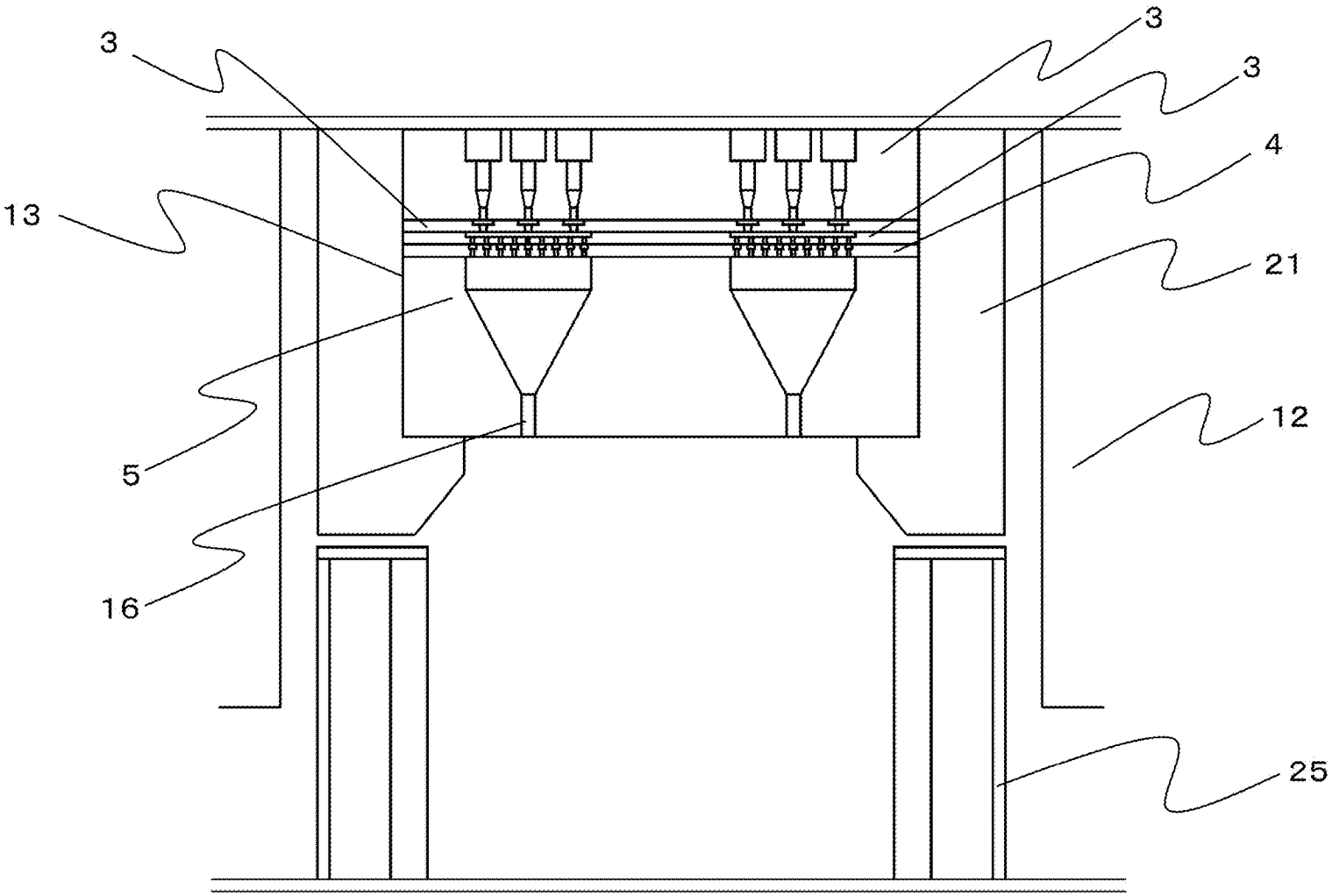
【Fig. 1】

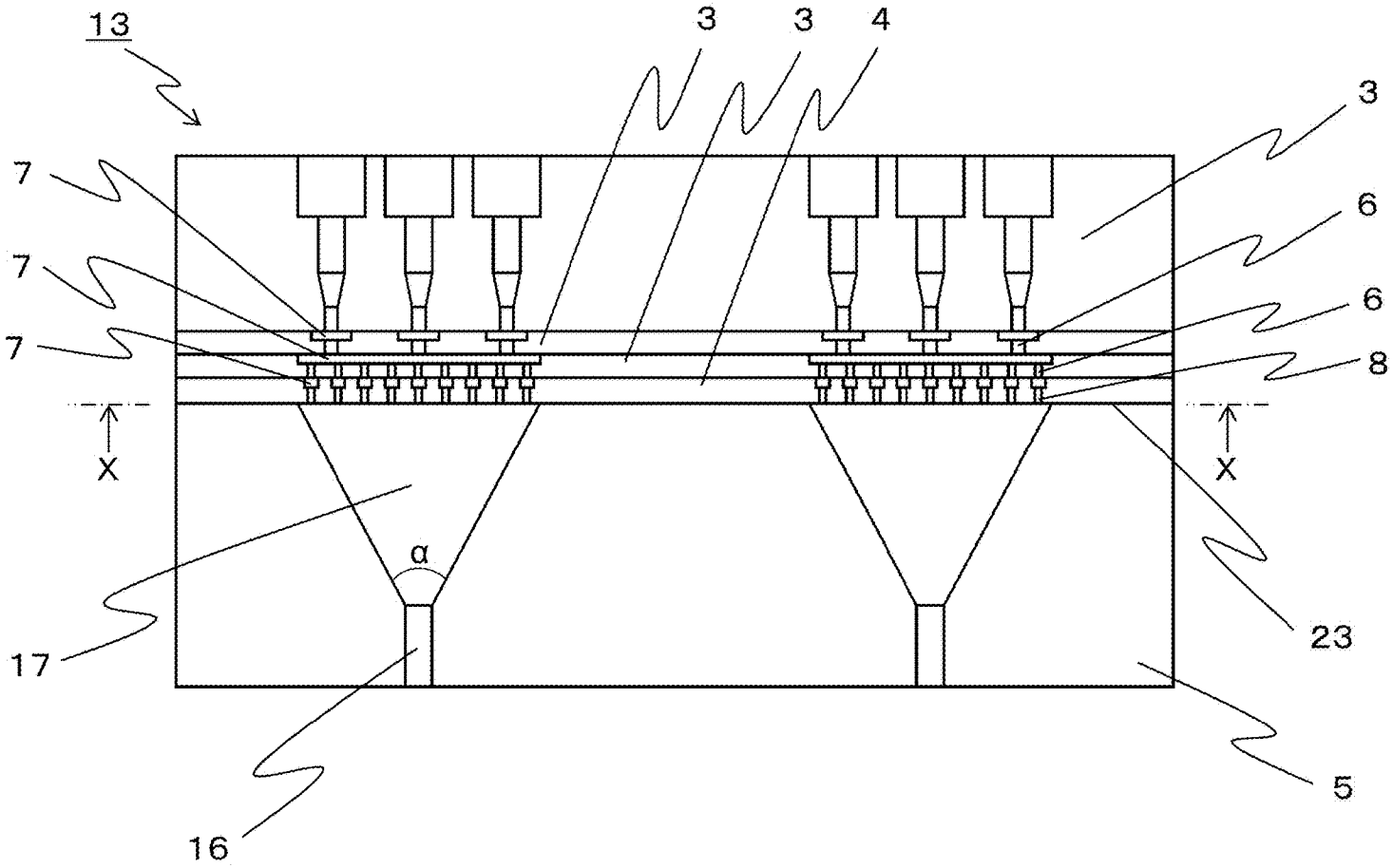
【Fig.2】

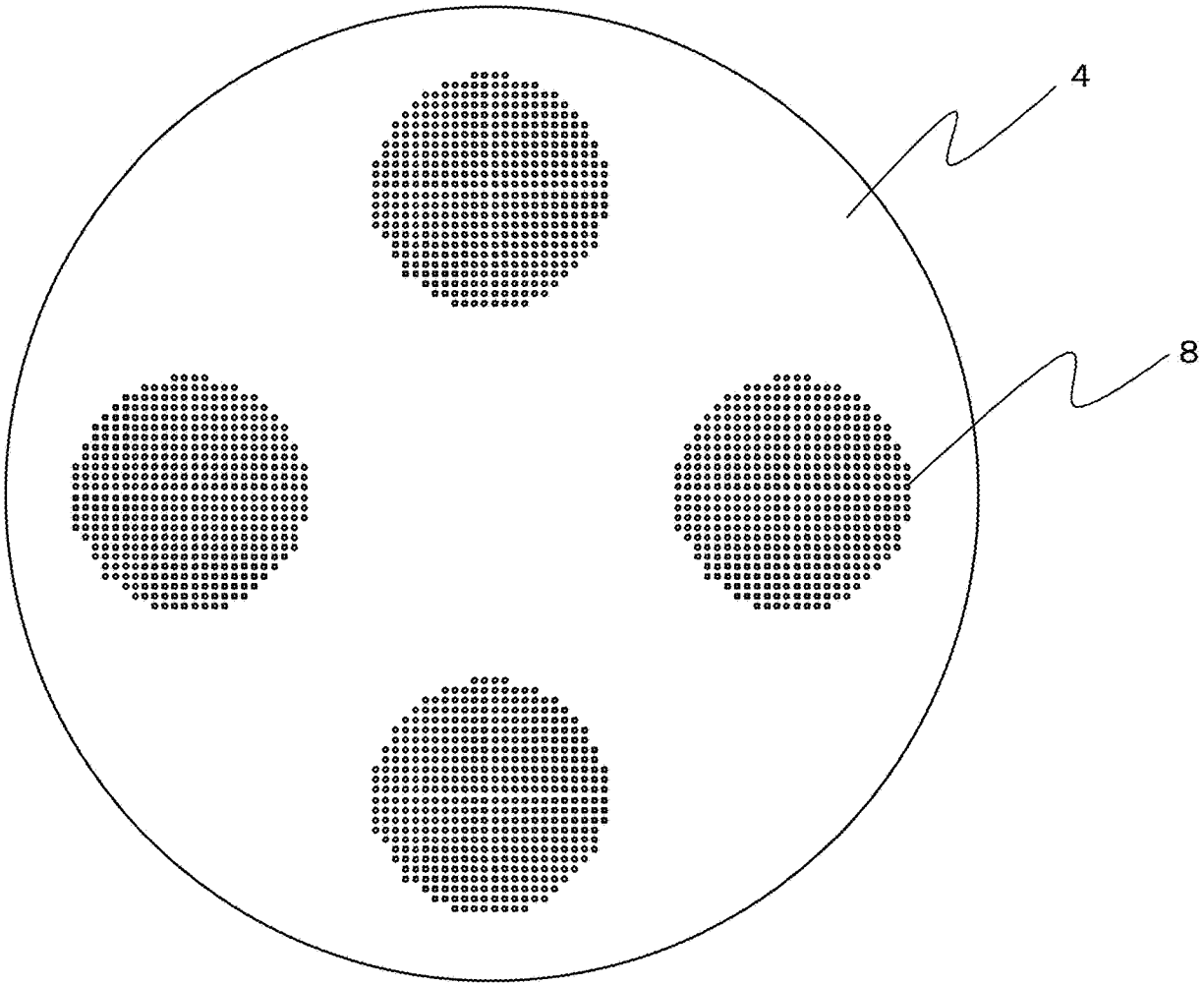
【Fig.3】

【Fig.4】
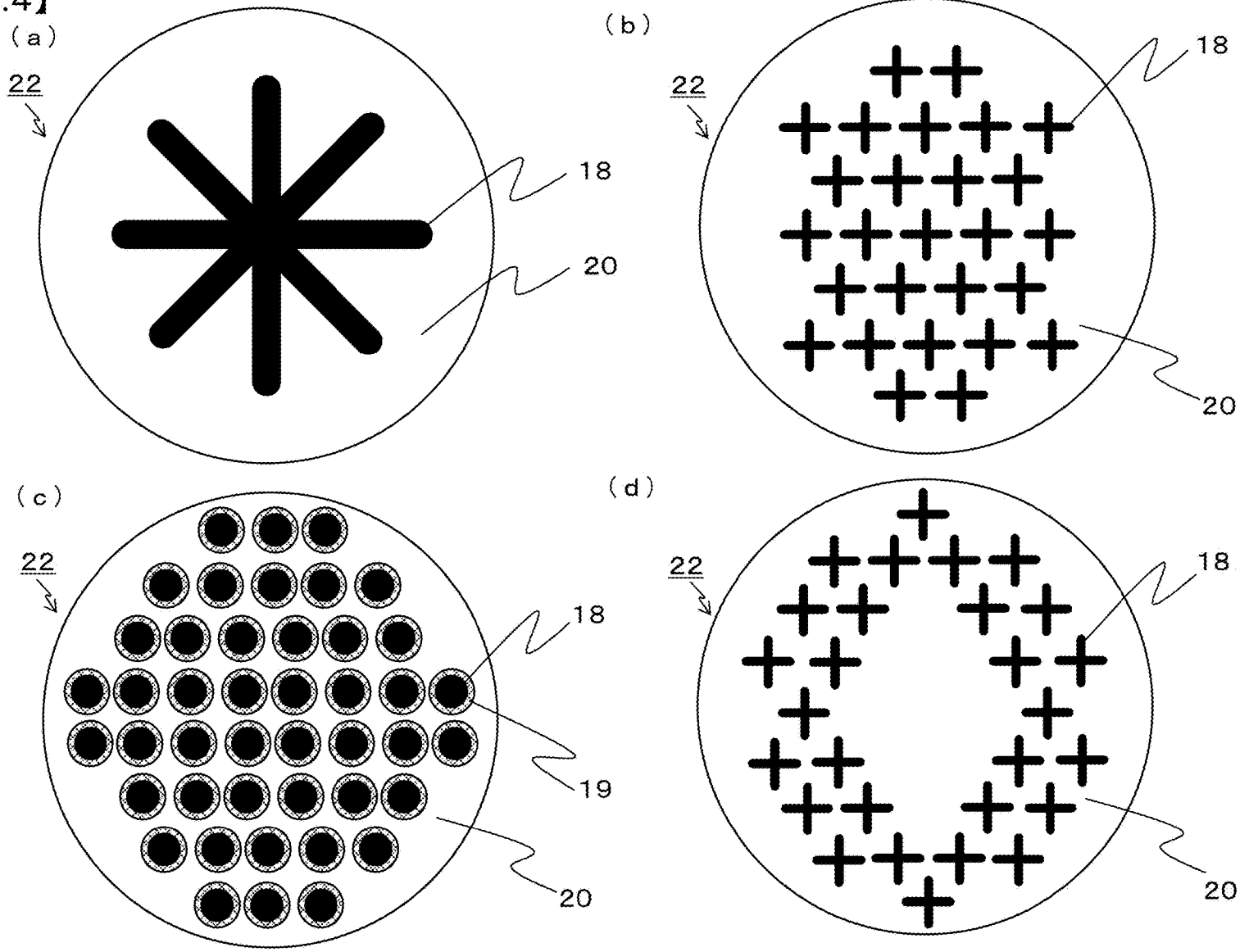

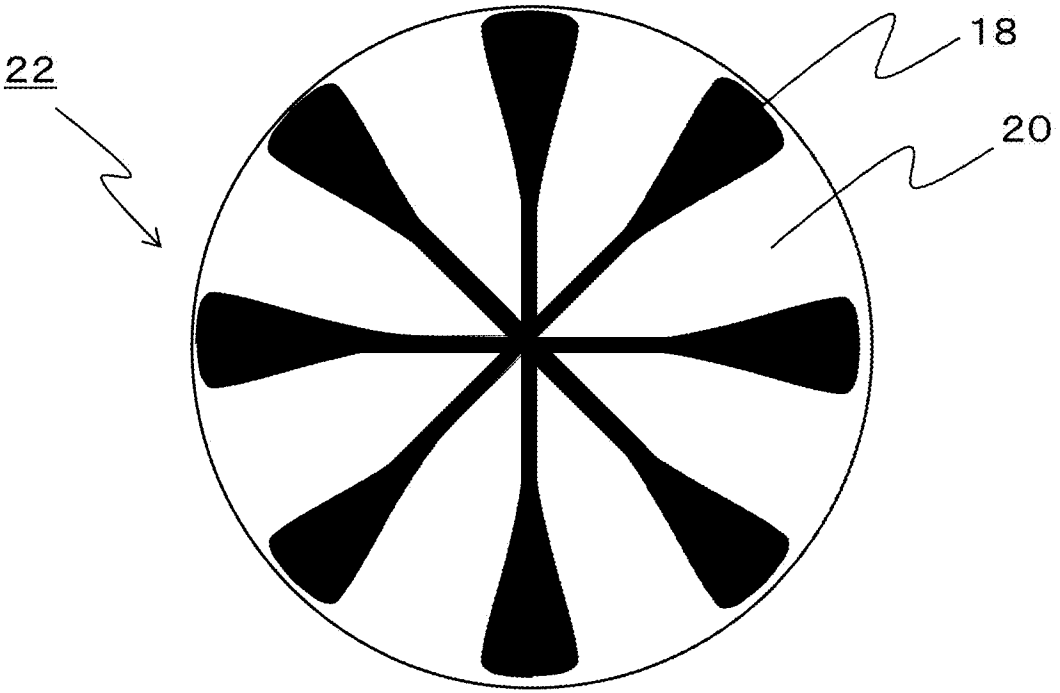
【Fig.5】

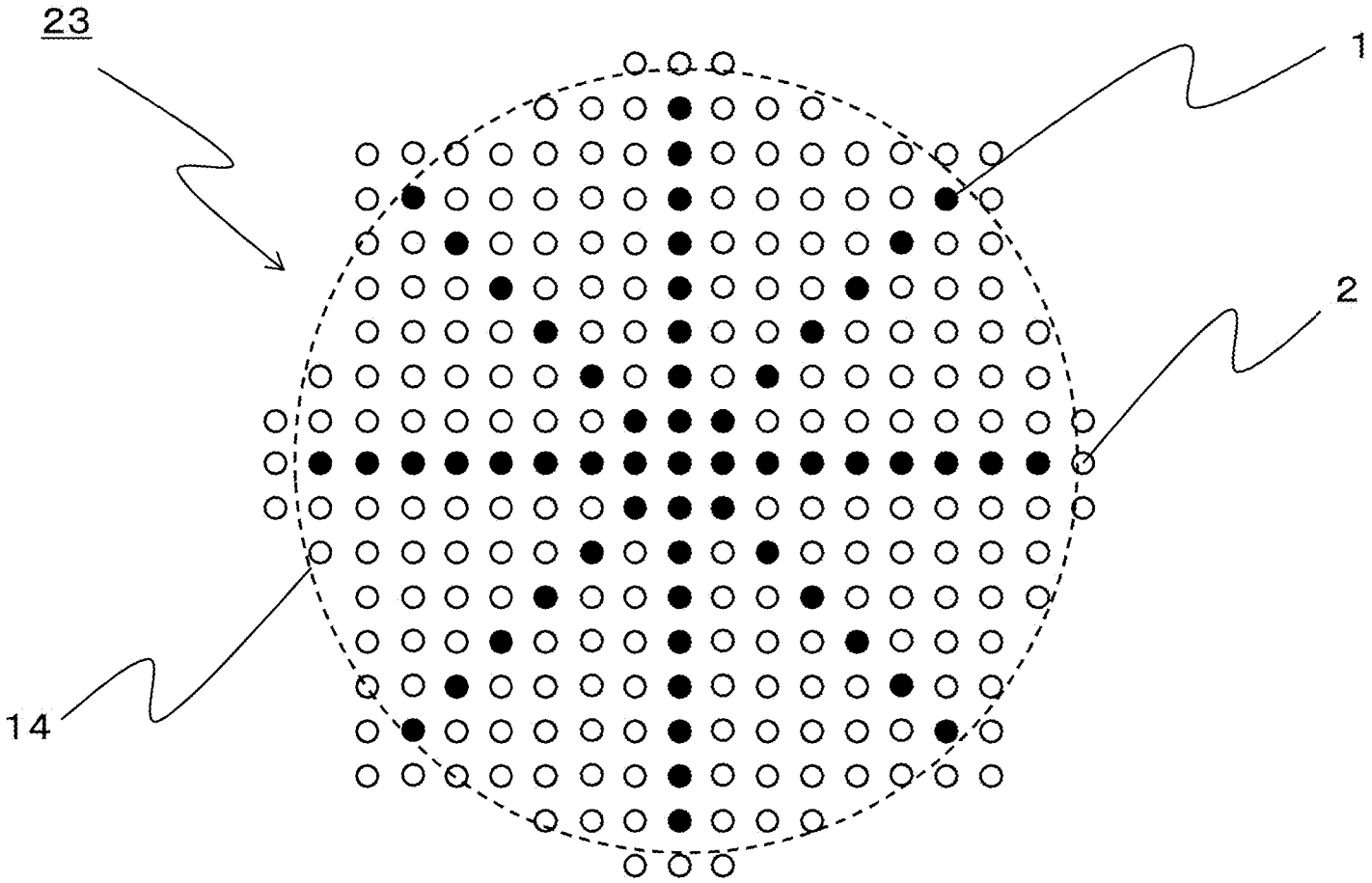
【Fig.6】

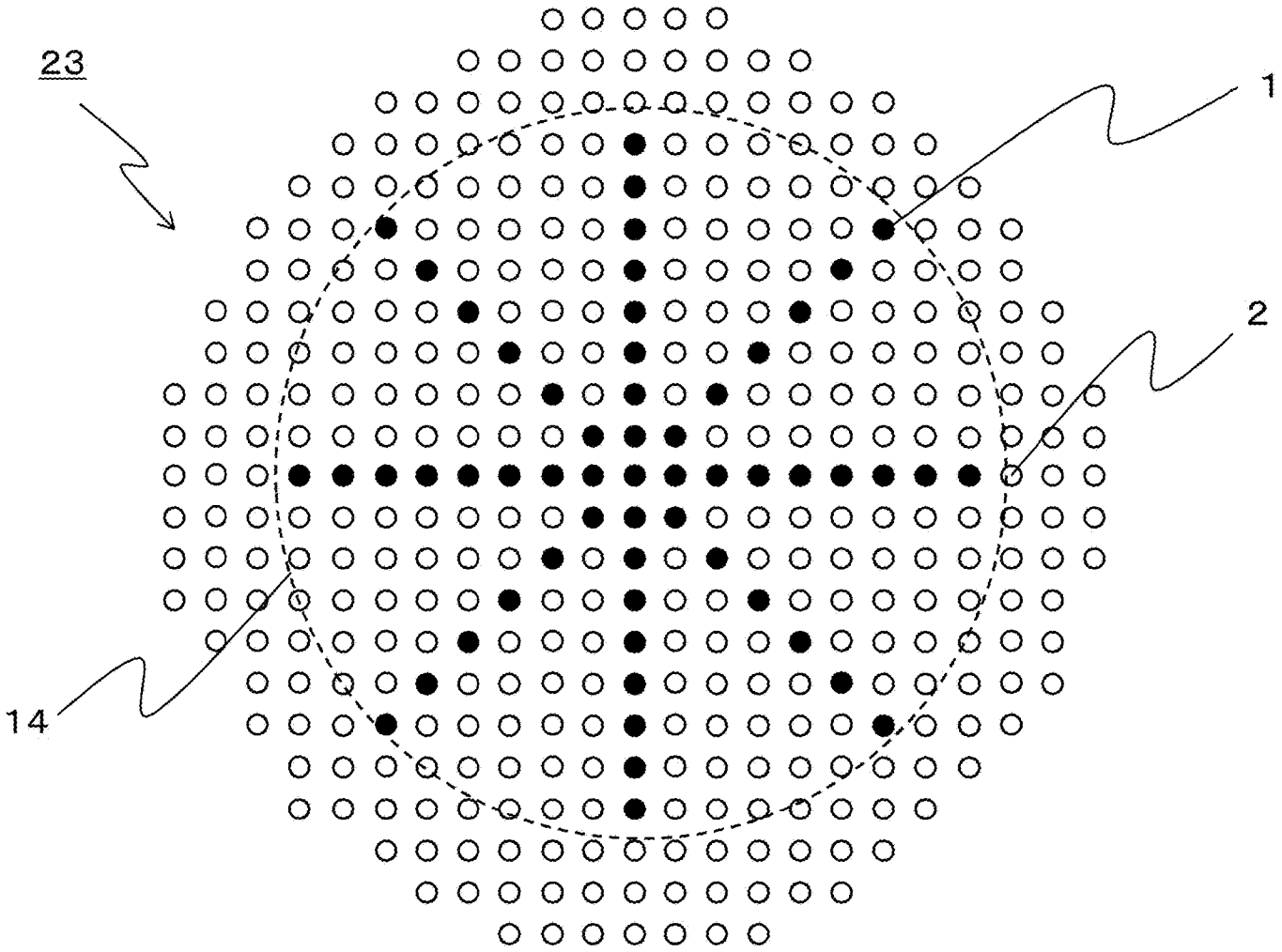
【Fig.7】

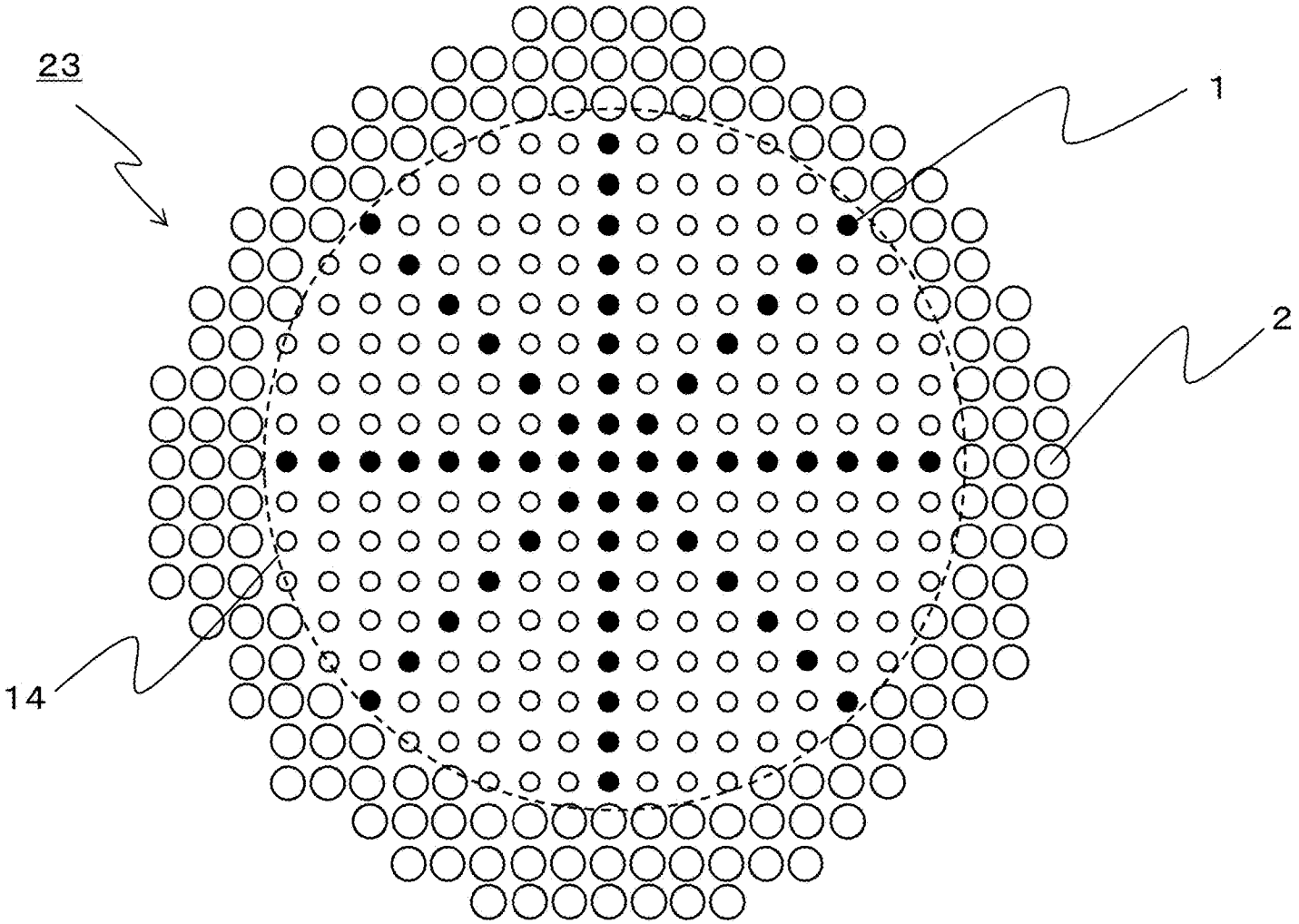
【Fig.8】

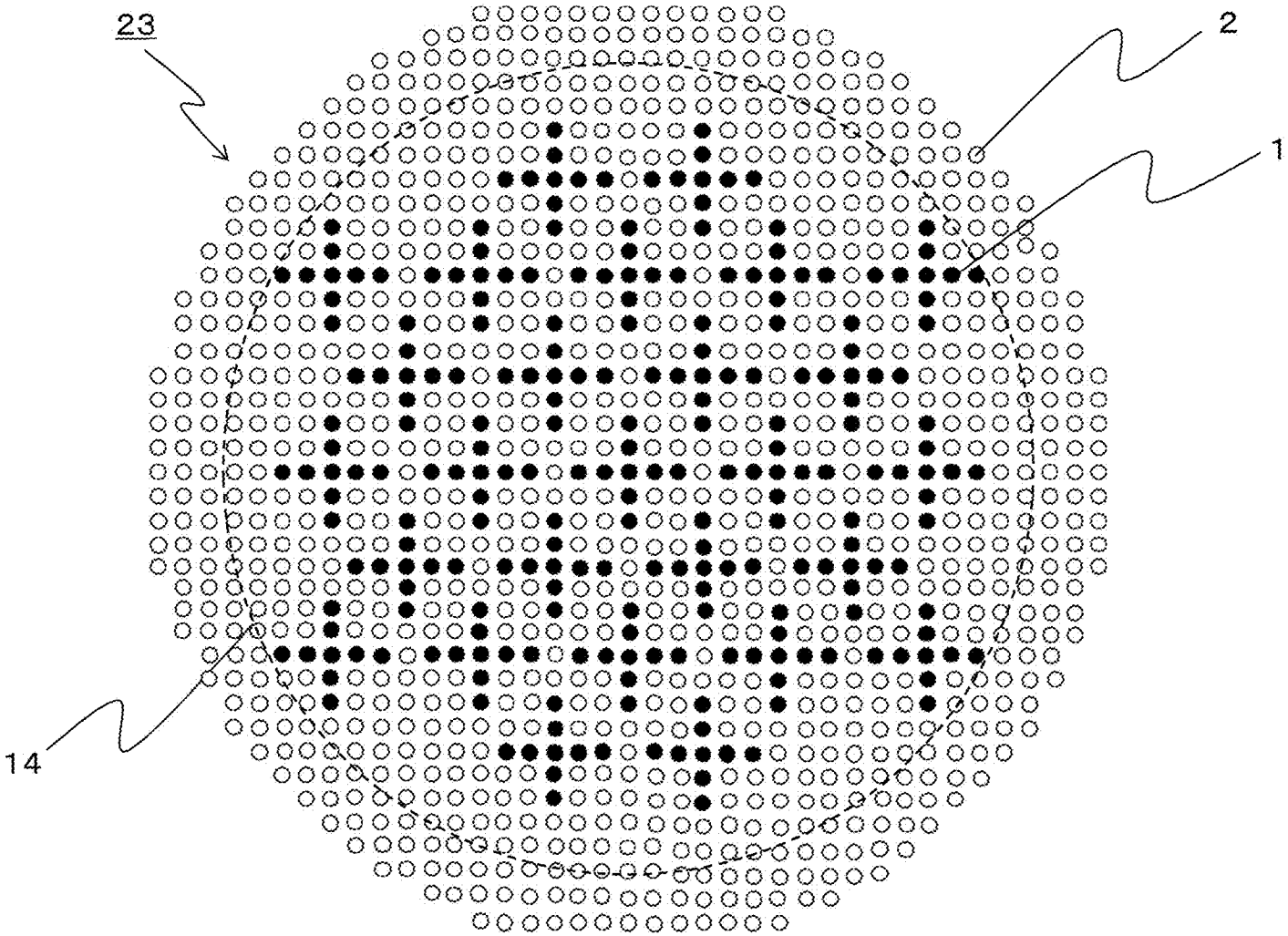
【Fig.9】

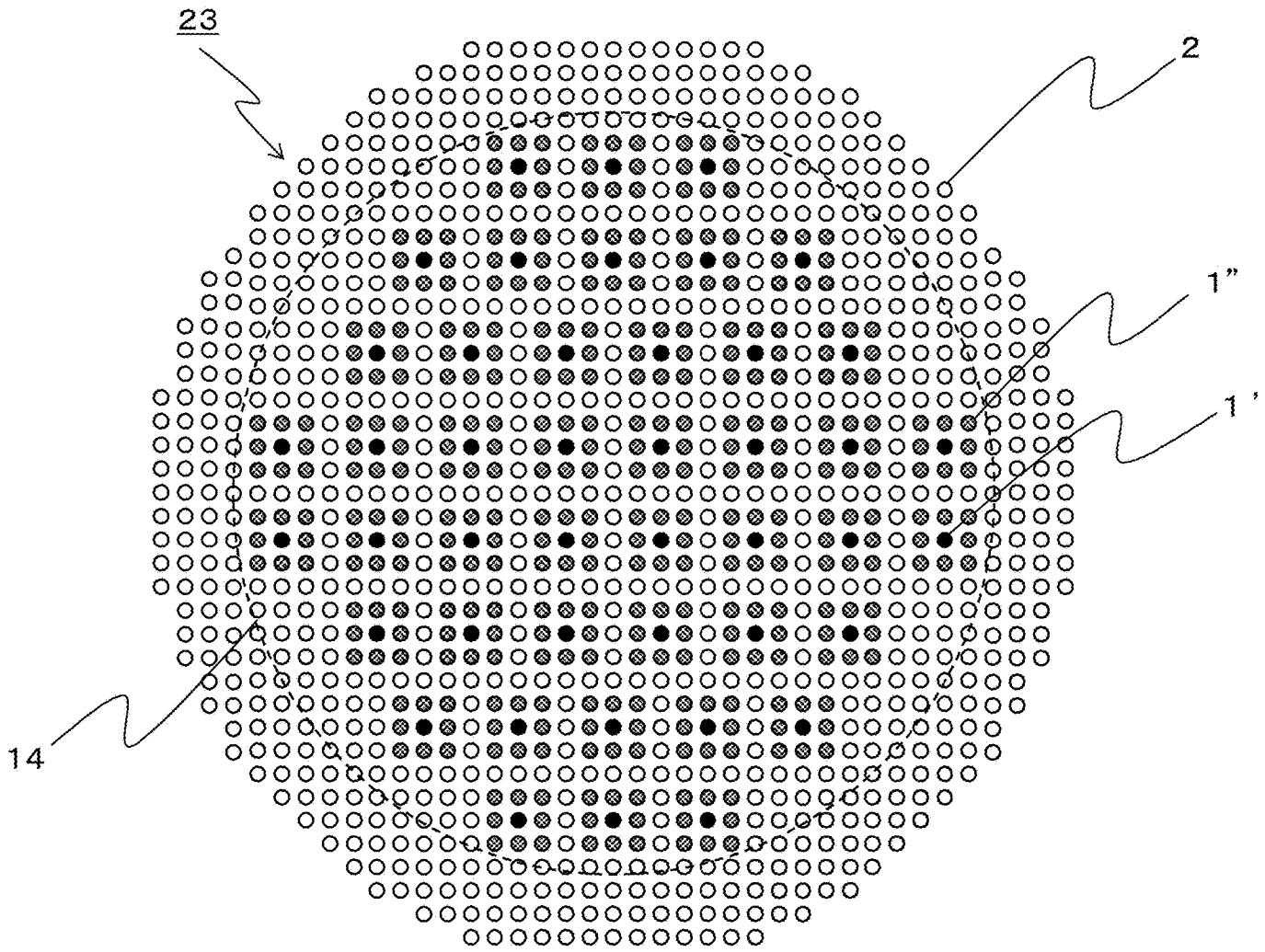
【Fig.10】

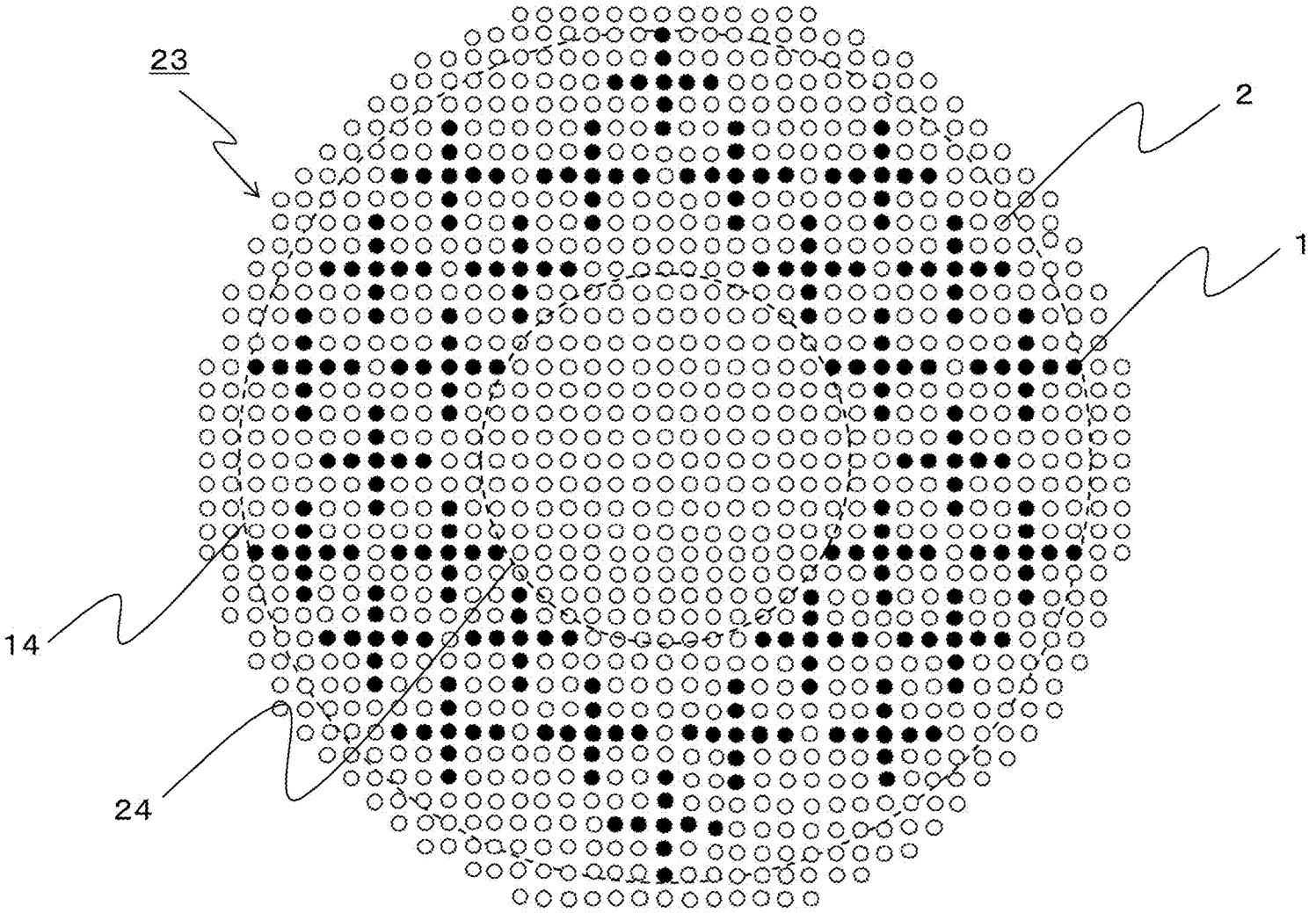
【Fig.11】

METHOD FOR PRODUCING COMPOSITE FIBER AND COMPOSITE SPINNERET

CROSS REFERENCE TO RELATED APPLICATIONS

This application is the U.S. National Phase of PCT/JP2023/006171, filed Feb. 21, 2023, which claims priority to Japanese Patent Application No. 2022-037754 filed Mar. 11, 2022, the disclosures of these applications being incorporated herein by reference in their entireties for all purposes.

FIELD OF THE INVENTION

The present invention relates to a method for producing a composite fiber composed of two or more types of polymers, and a composite spinneret to be used in the method for producing a composite fiber.

BACKGROUND OF THE INVENTION

Methods for producing a composite fiber include a composite spinning method using a composite spinneret such as a core-clad type, a side-by-side type, or an islands-in-the-sea type, and a polymer alloy method involving melt-kneading polymers. The composite spinning method is not different from the polymer alloy method in terms of principle in which two or more types of polymers are formed into a composite fiber, but the composite spinning method is considered to be superior to the polymer alloy method in that a highly accurate yarn cross section shape can be formed particularly in a travelling direction of a yarn by precisely controlling a composite polymer stream with a composite spinneret.

As an example using the composite spinning method, the core-clad type composite spinneret enables to provide sensitive effects such as textures and bulkiness or mechanical properties such as strength, elastic modulus and abrasion resistance which cannot be achieved by fibers of a single component only since a core component is covered with a clad component. The side-by-side type composite spinneret enables to exhibit a crimping property which cannot be obtained by fibers of a single component only and provide a stretching property and the like. In addition, due to the islands-in-the-sea type composite spinneret, it is possible to obtain an ultrafine fiber having a yarn diameter of nano-order in which only a hard-to-elute component (island component) remains as a result of the elution of an easy-to-elute component (sea component) from a melt-spun composite fiber. Since the ultrafine fiber has a large yarn surface area, the ultrafine fiber is superior in touch and drapability, and is widely used as a constituent material of a nonwoven fabric or a woven fabric. In particular, in recent years, the demand for a required yarn section shape has become very strict, and for example, in the core-clad type, a section with high roundness of the core component has been required. In the side-by-side type, an eccentric side-by-side section in which one polymer wraps the other polymer very thinly has been required. In the islands-in-the-sea type, a section with high roundness of the island component, a section with high arrangement accuracy among island components, and a section with many islands of the island component in a very complicated shape have been required.

Here, examples of the method for producing a composite fiber by the composite spinning method include the following methods. Specifically, first, a chip as a raw material is extruded by an extruder for each component to form a polymer, and the polymer is guided to a spin pack through a polymer pipe installed in a heating box. Thereafter, each component polymer is passed through a filter disposed in the spin pack to remove foreign substances, and distributed by a multi-hole plate. Thereafter, the respective component polymers are joined at a spinneret to form a composite polymer stream, and the composite polymer stream is discharged out of a discharge hole of the spinneret to form a composite fiber. A method for producing a composite fiber using such a spinneret is extremely important in determining a yarn cross section shape, and various methods have been specifically proposed.

For example, Patent Document 1 discloses that, as a method for producing a core-clad type composite fiber, in a composite spinneret that simultaneously discharges a plurality of core-clad fibers, the flow rate of a polymer discharged out of a discharge hole positioned at an outermost periphery is set to ½ of the flow rate of a polymer discharged out of a discharge hole in another region, so that a discharge amount in the discharge hole of the outermost periphery is made uniform, and core-clad concentricity is improved. It is disclosed that this is also applicable to a side-by-side type composite fiber.

In addition, Patent Document 2 discloses that as a method for producing a composite fiber having a multilayer laminated structure composed of two types of polymers in one flat fiber cross section, the uniformity of the laminated portion can be improved by feeding a polymer flow rate of 10 to 30% to both ends in the longitudinal direction of the flat fiber cross section positioned at the outermost layer of the multilayer laminated portion with respect to the total flow rate of the polymer flowing into the multilayer laminated portion.

Patent Document 3 discloses a composite spinneret for producing islands-in-the-sea type composite fibers having various island shapes though a detailed arrangement pattern of discharge holes is not disclosed. It is described that in the present spinneret, a plurality of island-component discharge holes for discharging the island-component polymer are collected and arranged in an arbitrary shape, and the island-component polymer streams are joined to one another, so that the island shape can be made into an arbitrary cross-sectional shape. Thus, for example, it is disclosed that a composite fiber having an island component with a complex cross section (star shape) in one fiber can be obtained.

PATENT DOCUMENTS

Patent Document 1: JP H04-222205 A
Patent Document 2: JP 2010-203005 A
Patent Document 3: JP 2011-208313 A

SUMMARY OF THE INVENTION

However, the conventional methods for producing a composite fiber have the problems described below. According to Patent Document 1, it is made possible to improve the uniformity of the composite fiber discharged from a discharge hole located at the outermost periphery of the composite spinneret, but there is no technical description for improving the cross-sectional uniformity of the composite fiber discharged from the discharge hole located inside the outermost periphery. According to the findings of the present inventors, by the method described in Patent Document 1, regarding the composite fiber discharged out of the discharge hole inside the composite spinneret, the uniformity of the cross section may be deteriorated depending on the arrangement of the discharge holes, the polymer physical properties (viscosity and viscosity difference), and the polymer discharge amount, and a cross section with high roundness may not be obtained in the case of a core-clad type fiber, and a cross section in which two polymers are uniformly bonded may not be obtained in the case of a side-by-side type fiber. In particular, in a case where the number of lines of the composite fiber obtained from one composite spinneret is large (multi-line yarn), in a case where the number of islands located in one composite fiber is large (multi-islands), in a case where the shape of island located in one composite fiber is very complicated, or in a case where it is necessary to arrange the island component with very high accuracy in one composite fiber, the degree of difficulty in forming a fiber cross section becomes very high, so that the technique disclosed in Patent Document 1 may not be applicable.

In Patent Document 2, it is possible to improve the uniformity of the laminated portion if the fiber cross section is limited to a flat fiber cross section, but according to the findings of the present inventors, if the fiber cross section has a general circular shape, merely feeding a polymer to the outermost layer side of the multilayer laminated portion results in an insufficient flow rate of the polymer fed in a direction perpendicular to the laminating direction of the multilayer laminated portion, and as a result in some cases, the laminated cross section is deformed in the direction perpendicular to the laminating direction and the uniformity of the laminated portion is not be maintained.

Patent Document 3 describes, as a method for forming an island shape, arranging a plurality of island-component discharge holes densely, but does not disclose the arrangement of discharge holes for the sea component as the other polymer component. According to findings by the present inventors, for example, in order to form a star-shaped island with high accuracy, unless not only the island-component polymer but also the sea-component polymer is fed with the sea-component discharge holes being appropriately arranged around the island-component discharge holes, some of the island-component polymer flows to the outside of one composite fiber, and a star-shaped island may not be formed.

As described above, not only feeding the island-component polymer according to a desired island shape but also appropriately feeding the other sea-component polymer to the outer peripheral side of the island-component polymer is an extremely important factor in producing a composite fiber having complicated and highly accurate island shapes are located. However, various problems remain as described above, and solving this problem has an important industrial meaning.

Therefore, an object of the present invention is to provide a method for producing a composite fiber, the method being capable of forming a composite cross-sectional shape of a composite spinneret with high accuracy and maintaining high dimensional stability of the cross-sectional shape, and to provide a composite spinneret.

The present invention, which solves the above problems, adopts any of the following configurations.

(1) A method for producing a composite fiber, the method comprising: distributing a sea-component polymer and at least one other-component polymer different from the sea-component polymer by a distribution plate; discharging the sea-component polymer and the other-component polymer distributed by the distribution plate respectively from sea-component discharge holes and other-component discharge holes of a discharge plate positioned at a downstream side of the distribution plate with respect to a polymer spinning path direction, thereby forming at least one composite polymer; and discharging the composite polymer from a discharge hole of a spinneret discharge plate positioned at a downstream side of the discharge plate with respect to the polymer spinning path direction, wherein in a discharge face of the discharge plate, corresponding to the one composite polymer, there is at least one hole group in which a plurality of the sea-component discharge holes is located to surround one or a plurality of the other-component discharge holes, and in the one hole group, where a circle with a minimum diameter including all the other-component discharge holes thereinside is defined as an imaginary circle, an entire discharge amount $Q_{out}$ of the sea-component polymer discharged from all sea-component discharge holes located in a region outside the imaginary circle and an entire discharge amount $Q_{in}$ of the sea-component polymer discharged from all sea-component discharge holes located in a region inside the imaginary circle satisfy $Q_{out}/Q_{in} \geq 0.5$.

(2) The method for producing a composite fiber according to claim 1, wherein in the one hole group, a sum total $S_{in}$ of hole areas of all the sea-component discharge holes located in the region inside the imaginary circle and a sum total $S_{out}$ of hole areas of all the sea-component discharge located in the region outside the imaginary circle satisfy $S_{in}/S_{out} \geq 0.5$.

(3) The method for producing a composite fiber according to the above (1) or (2), wherein in the one hole group, a hole area of one sea-component discharge holes located in the region outside the imaginary circle is larger than a hole area of one sea-component discharge located in the region inside the imaginary circle.

(4) The method for producing a composite fiber according to any one of the above (1) to (3), wherein in the one hole group, a discharge amount of the sea-component polymer discharged from one sea-component discharge holes located in the region outside the imaginary circle is larger than a discharge amount of the sea-component polymer discharged from one sea-component discharge holes located in the region inside the imaginary circle.

(5) A composite spinneret for discharging at least one composite polymer stream composed of a sea-component polymer and at least one type of other-component polymer different from the sea-component polymer, the composite spinneret comprising:

a distribution plate for distributing the sea-component polymer and the other-component polymer;

a discharge plate which is positioned at a downstream side of the distribution plate with respect to a polymer spinning path direction and which is provided with sea-component discharge holes for discharging the sea-component polymer and other-component discharge holes for discharging the other-component polymer; and a spinneret discharge plate which is positioned at a downstream side of the discharge plate with respect to a polymer spinning path direction and which is provided with a discharge hole for discharging the composite polymer, wherein in a discharge face of the discharge plate, corresponding to the one composite polymer stream, there is at least one hole group in which a plurality of the sea-component discharge holes is located to surround one or a plurality of the other-component discharge holes, and in the one hole group, where a circle with a minimum diameter including all the other-component discharge holes thereinside is defined as an imaginary circle, a hole area of one sea-component discharge holes located in a region outside the imaginary circle is larger than a hole area of one sea-component discharge holes located in a region inside the imaginary circle.

Here, in the present invention, "a polymer spinning path direction" refers to a main direction in which each polymer component flows from a distribution plate to a spinneret discharge hole of a spinneret discharge plate.

In the present invention, "a discharge face of a discharge plate" refers to a discharge face facing the downstream side of the discharge plate with respect to the polymer spinning path direction.

In the present invention, "all sea-component discharge holes located in a region outside an imaginary circle" refers to all sea-component discharge holes located in a region outside an imaginary circle including the circular line of the imaginary circle.

In the present invention, "all sea-component discharge holes located in a region inside an imaginary circle" refers to all sea-component discharge holes located in a region inside an imaginary circle not including the circular line of the imaginary circle.

In the present invention, "corresponding to one composite polymer" and "corresponding to one composite polymer stream" mean that an imaginary circle is assumed for each group of discharge holes for an individual composite polymer. Accordingly, for example, when four composite polymers or composite polymer streams are formed at a composite spinneret, four imaginary circles are assumed. It is noted that in one composite spinneret, because sea-component discharge holes and other-component discharge holes are usually located in the same manner among hole groups, the relationship in a hole group is the same among hole groups.

Due to the method for producing a composite fiber and the composite spinneret of the present invention, by feeding the other-component polymer according to a desired shape as well as feeding an appropriate amount of the sea-component polymer to the outer peripheral side of a composite fiber to form a composite polymer stream, it is possible to form various fiber cross section shapes with high accuracy, and maintain the dimensional stability of the cross section shapes at a high level.

BRIEF DESCRIPTION OF THE DRAWINGS

FIG. 1 is a schematic cross-sectional view of a composite spinneret to be used in one embodiment of the present invention, and peripheral devices such as a spin pack and a cooling device.

FIG. 2 is a schematic cross-sectional view of a composite spinneret showing one embodiment of the present invention.

FIG. 3 is a view taken in a direction of arrows X-X in FIG. 2, and is an overall view of a discharge face of a discharge plate.

FIG. 4 is a schematic cross-sectional view of a typical composite fiber that can be produced by the present invention.

FIG. 5 is a schematic cross-sectional view of a composite fiber to be produced by a conventional method.

FIG. 6 is a partially enlarged cross-sectional view of a discharge face of a discharge plate to be used in a conventional method.

FIG. 7 is a partially enlarged cross-sectional view of a discharge face of a discharge plate to be used in the present invention.

FIG. 8 is a partially enlarged cross-sectional view of a discharge face of a discharge plate to be used in the present invention.

FIG. 9 is a partially enlarged cross-sectional view of a discharge face of a discharge plate to be used in the present invention.

FIG. 10 is a partially enlarged cross-sectional view of a discharge face of a discharge plate to be used in the present invention.

FIG. 11 is a partially enlarged cross-sectional view of a discharge face of a discharge plate to be used in the present invention.

DETAILED DESCRIPTION OF EMBODIMENTS OF THE INVENTION

Hereinafter, embodiments of the method for producing a composite fiber of the present invention will be described in detail with reference to drawings. It is note that the drawings are conceptual diagrams for accurately describing the main points of the present invention and are simplified. Therefore, the production method and the composite spinneret of the present invention are not particularly limited to the drawings, and the number of holes and grooves, and the dimensional ratios of holes and grooves may be changed according to the embodiment.

As illustrated in FIG. 1, the composite spinneret 13 to be used in an embodiment of the present invention is mounted in a spin pack 21, and the spin pack 21 is fixed in a spin block 12. A cooling device 25 is disposed immediately below the composite spinneret 13.

As illustrated in FIG. 2, the composite spinneret 13 is constituted of at least one or more distribution plates 3, a discharge plate 4, and a spinneret discharge plate 5 laminated in this order, and a sea-component polymer introduced into the composite spinneret 13 and at least one other-component polymer different from the sea-component polymer each pass through the distribution plates 3 and the discharge plate 4 and are discharged in a state of being composited out of a spinneret discharge hole 16 of the spinneret discharge plate 5. The composite polymer discharged out of the spinneret discharge hole 16 is then cooled by an air flow blown out from the cooling device 25, provided with a spinning oil, and then wound as a composite fiber.

Although an annular cooling device 25 that blows out an air flow annularly inward is adopted in FIG. 1, a cooling device that blows out an air flow in one direction may be used. As for a member to be mounted on the upstream side from the distribution plate 3, a flow passage or the like to be used in the existing spin pack 21 may be used, and it is not particularly necessary to exclusively use the member.

The discharge plate 4 is preferably constituted of a thin plate. The discharge plate 4 may be positioned together with the distribution plate 3 and the spinneret discharge plate 5 so as to be aligned with a center position (core) of the spin pack 21 with a locating pin, laminated, and then fixed with a screw, a bolt, or the like, or metal-joined by thermocompression bonding.

The polymers of the respective components fed to the distribution plates 3 pass through distribution grooves 7 and distribution holes 6 of the at least one or more distribution plate 3 laminated, and then are discharged out of the other-component discharge holes 1 for discharging the other-component polymer of the discharge plate 4 and the sea-component discharge holes 2 for discharging the sea-component polymer, respectively. Then, in a joining hole 17, the other-component polymers discharged out of adjacent other-component discharge holes 1 join to form an island shape, while the sea-component polymers discharged out of adjacent sea-component discharge holes 2 join to surround the other-component polymer (island-component polymer), to form a composite polymer. Thereafter, the composite polymer is discharged as a composite fiber out of a spinneret discharge hole 16 of the spinneret discharge plate 5. Each composite fiber is formed by discharging composite polymers out of the spinneret discharge hole 16, the composite polymers having been discharged out of the other-component discharge holes 1 and the sea-component discharge holes 2 (hereinafter, sometimes collectively referred to as discharge holes 8) and then joined. In the present invention, one composite polymer or composite fiber may be formed from one composite spinneret, or a plurality of composite polymers or composite fibers may be formed from one composite spinneret. FIG. 3 is a schematic view of a discharge plate by which four composite fibers are to be formed.

Here, the principle by which various fiber cross section shapes can be formed with high accuracy will be described. In order to arrange the other-component polymer (A) 18 in a shape like a radially spreading linear body (hereinafter referred to as an island shape) in one composite fiber 22 as illustrated, for example, in FIG. 4(*a*), it is relatively easily imagined to combine, in a discharge face 23 of a discharge plate 4, a plurality of other-component discharge holes 1 in an island shape and arrange them in a collection (hole group) and arrange sea-component discharge holes 2 so as to surround the hole group. By merely employing this configuration, however, an intended island shape cannot be formed, and a distorted shape like a linear body with thickened tips is likely to be formed as illustrated in FIG. 5. For example, at a place where an island shape is to be complicated (a place that corresponds to a central part of the composite fiber illustrated in FIG. 4(*a*)), it is necessary to form an island shape by finely arranging a large number of sea-component discharge holes 2, and by finely dividing the sea-component polymer in advance with a distribution plate 3 and discharging the divided sea-component polymers through respective sea-component discharge holes 2. In the conventional discharge plate 4 illustrated in FIG. 6, however, in order to obtain a certain number of composite fibers from a spinneret having a prescribed size, it may not be able to sufficiently secure a region where sea-component discharge holes 2 for forming an outer peripheral part of a composite fiber 22 are arranged (a region outside the hole group of the other-component discharge holes 1). In this case, the flow rate of the sea-component polymer capable of being fed to the outer peripheral part of the other-component polymer (A) decreases, and as a result, a composite polymer is greatly drifted on the downstream side from the discharge face 23 and deformation of the island shape occurs. That is, merely surrounding the hole group of the other-component discharge holes 1 by the sea-component discharge holes 2 makes it very difficult to control the island shape of a composite fiber highly accurately. There is a method of increasing the region where the sea-component discharge holes 2 are arranged by increasing the size of the discharge plate 4. However, the size of the discharge plate 4 affects the size of the composite spinneret 13 and also affects the size of the spin pack 21, so that the number of the sea-component discharge holes 2 that can be arranged in the discharge plate 4 is limited.

Therefore, a technique of forming a composite polymer stream that involves arranging the sea-component discharge holes 2 on the discharge face 23 according to the island shape of a desired composite fiber and feeding an appropriate amount of the sea-component polymer to the outer periphery side of the other-component polymer serves as an extremely important technique for producing a composite fiber. The present inventors have intensively studied the above problems that have not been considered in techniques in the related art, and as a result, have found a new technique of the present invention.

In the present invention, as illustrated in FIG. 7, the discharge face 23 of the discharge plate 4 is provided for each composite polymer stream with a hole group in which a plurality of sea-component discharge holes 2 are located so as to surround one or a plurality of other-component discharge holes 1. Each hole group is configured to satisfy $Q_{out}/Q_{in} \geq 0.5$ where a circle with a minimum diameter including all the other-component discharge holes 1 thereinside is imagined; an entire discharge amount [g/min] of the sea-component polymer discharged from all sea-component discharge holes 2 located in a region outside the imaginary circle 14 is denoted by $Q_{out}$; and an entire discharge amount [g/min] of the sea-component polymer discharged from all sea-component discharge holes 2 located in a region inside the imaginary circle 14 is denoted by $Q_{in}$. By controlling the polymer discharge amount in this manner, or specifically, by, while feeding a necessary amount of the sea-component polymer to a region inside the imaginary circle 14, which is a place where a complicate island shape will be formed (the central part of a composite fiber in FIG. 4(*a*)), feeding the sea-component polymer to a region outside the imaginary circle 14 in an amount corresponding to half or more of the entire discharge amount of the sea-component polymer to be fed to the inside, it is possible to inhibit the island shape inside the imaginary circle 14 from drifting toward the outer periphery side. As a result, it becomes possible to form an outer peripheral portion of the composite fiber and obtain a good island shape. That is, a very complicated cross section of the composite fiber 22 as illustrated in FIG. 4(*a*) can be obtained. When $Q_{out}/Q_{in}$ is less than 0.5, since the amount of the sea-component polymer to be fed to the region outside the imaginary circle 14 is small, namely, since the flow rate of the sea-component polymer to be fed to the outer peripheral portion of the composite fiber is small, it is difficult to sufficiently inhibit the deformation of the island shape.

In addition, by setting the entire discharge amount $Q_{out}$ of the sea-component polymer fed to the region outside the imaginary circle 14 to be equal to or more than the entire discharge amount $Q_{in}$ of the sea-component polymer fed to the region inside the imaginary circle ($Q_{out}/Q_{in} \geq 1$), the island shape can be further stabilized, and a more favorable island shape can be obtained. In particular, as illustrated in FIG. 3, since the outer periphery of the hole groups of the discharge holes 8 (a combination of the other-component discharge holes 1 and the sea-component discharge holes 2) is close to the wall surface of the spinneret discharge plate 5, the composite polymer is likely to be subjected to a shearing force, and the island shape is prone to be disturbed. Therefore, the island shape can be stabilized by increasing the sea-component polymer in the region outside the imaginary circle 14. On the other hand, $Q_{out}/Q_{in}$ is preferably set to 8 or less. By setting $Q_{out}/Q_{in}$ to 8 or less, the amount of the sea-component polymer to be fed to the region inside the imaginary circle 14 can be sufficiently secured, that is, the amount of the sea-component polymer in the inner peripheral portion of the composite fiber can be made sufficient, and minute deformation of the island shape can be more reliably prevented.

Further, in each hole group, in the discharge face 23 of the discharge plate 4, the sum total Si, of the hole areas of all the sea-component discharges 2 located in the region inside the imaginary circle 14 and the sum total $S_{out}$ of the hole areas of all the sea-component discharge holes 2 located in the region outside the imaginary circle 14 preferably satisfy $S_{in}/S_{out} \geq 0.5$. Thereby, the flow rate of the sea-component polymer discharged from the sea-component discharge holes 2 located in the region inside the imaginary circle 14 can be increased, and the cross section of the composite fiber 22 can be further stabilized. $S_{in}/S_{out}$ is more preferably 0.75 or more. The upper limit of $S_{in}/S_{out}$ is not particularly limited, and may be set within a practical range. However, as the ratio is larger, the island shape is more stabilized, while the number of sea-component discharge holes 2 that can be located outside the imaginary circle 14 decreases. Therefore, from the viewpoint of ensuring the flow rate of the sea-component polymer that can be fed to the outer peripheral portion of the composite fiber and forming an island shape, $S_{in}/S_{out}$ is preferably 3 or less.

In each hole group, as illustrated in FIG. 8, the hole area $Sa_{out}$ of one sea-component discharge hole 2 located in the region outside the imaginary circle 14 is preferably larger than the hole area $Sa_{in}$ of one sea-component discharges 2 located in the region inside the imaginary circle 14. In the present invention, since the flow rate of the sea-component polymer discharged from the sea-component discharge holes 2 located in the region outside the imaginary circle 14 is half or more of the flow rate of the sea-component polymer discharged from the sea-component discharge holes 2 located in the region inside the imaginary circle 14, the pressure loss in the sea-component discharge holes 2 located in the region outside the imaginary circle is large. However, by increasing in advance a hole area $Sa_{out}$ of the sea-component discharge holes 2 located in the outer region, the pressure loss can be reduced. In addition, it is possible to further inhibit the variation in the island shape with time lapse and to stabilize the island shape because it is possible to reduce the difference in flow velocity between the polymers discharged from the sea-component discharge holes 2 located on the outer side and the inner side.

When the hole areas of the sea-component discharge holes 2 located in the region outside the imaginary circle 14 are different from each other, the average value of the hole areas of the sea-component discharge holes 2 may be taken as the hole area $Sa_{out}$ of one sea-component discharge hole 2. The same applies to the case where the hole areas of the sea-component discharges 2 located in the region inside the imaginary circle 14 are different.

In each hole group, in the discharge face 23 of the discharge plate 4, it is preferable that the discharge amount $Qa_{out}$ of the sea-component polymer discharged from one sea-component discharge hole 2 located in the region outside the imaginary circle 14 is larger than the discharge amount $Qa_{in}$ of the sea-component polymer discharged from one sea-component discharge hole 2 located in the region inside the imaginary circle 14. As a result, it is possible to reduce the number of the sea-component discharge holes 2 located in the region outside the imaginary circle 14 and increase the number of the sea-component discharge holes 2 located in the region inside the imaginary circle 14, and it is also possible to increase the number of the other-component discharge holes 1, so that it becomes possible to form a cross section of a composite fiber having a more complicated island shape. When the discharge amounts of the sea-component polymer discharged from the respective sea-component discharge holes 2 located in the region outside the imaginary circle 14 are different from each other, the average value of the sea-component polymer discharged from the respective sea-component discharge holes 2 can be taken as the discharge amount $Qa_{out}$ discharged from one sea-component discharge hole 2. The same applies to the case where the discharge amounts of the sea-component polymer discharged from the respective sea-component discharge holes 2 located in the region inside the imaginary circle 14 are different from each other.

Next, other embodiments of the present invention will be described on the basis of the discharge plates illustrated in FIGS. 9, 10, and 11. FIG. 9 is a view illustrating a hole arrangement of the discharge face 23 for producing the composite fiber of FIG. 4(*b*) (a plurality of cross-shaped islands is arranged), and FIG. 10 is a hole arrangement of the discharge face 23 for producing the composite fiber of FIG. 4(*c*) (the other-component polymer is composed of two types of polymers, and a plurality of core-clad type islands are arranged). The hole arrangement of the present invention is not limited thereto, and may be a hole arrangement in which the island shape is a bimetal type, or may be a hole arrangement in which the other-component polymer is composed of three or more components (three-layer laminated cross section). In particular, when the island shape is a complicated shape and many other-component discharge holes 1 and sea-component discharge holes 2 are required, the present invention is suitable, and a wide variety of fiber cross section shape can be formed with high accuracy.

FIG. 11 illustrates the hole arrangement of the discharge face 23 for producing the composite fiber of FIG. 4(*d*) (a plurality of cross-shaped islands is arranged; while the island component is disposed at the center of a composite fiber in FIGS. 4(*a*) to 4(*c*), a sea component is disposed at the center of the composite fiber in this embodiment). Also in this case, $Q_{out}/Q_{in} \geq 0.5$ is satisfied. However, for example, in the case where the central region where no island exists is large, in order to prevent islands more reliably from drifting to the center or the outside, the following configuration is preferable. That is, in the discharge face 23 of the discharge plate 4, when a circle having a maximum diameter with all the other-component discharge holes 1 being located outside the circle is imagined as a second imaginary circle 24, and the entire discharge amount of the sea-component polymer discharged from all the sea-component discharge holes 2 located in the region sandwiched between the second imaginary circle 24 and the imaginary circle 14 is denoted by $Q_{in2}$, the entire discharge amount $Q_{out}$ of the sea-component polymer discharged from all the sea-component discharge holes 2 located in the region on the outer side of the imaginary circle 14 satisfies $Q_{out}/Q_{in2} \geq 1.05$. This is because the region where a complicated island shape of the composite fiber is formed is a region being outside the second imaginary circle 24 and inside the imaginary circle 14 on the discharge face 23 in FIG. 11, and therefore, while feeding the sea-component polymer at a required flow rate to that region, it is necessary to sufficiently feed the sea-component polymer to other regions so that the island shape does not drift to the center or the outside.

Next, respective members common to the composite spinneret 13 of the present invention illustrated in FIGS. 1 and 2 will be described in detail. The composite spinneret 13 in the present invention is not limited to a circular form, and may be a tetragonal form or a polygonal form. In addition, the array of the spinneret discharge holes 16 in the composite spinneret 13 may be appropriately determined according to the number of the multifilament yarns, the number of lines of yarn, and the cooling device 25. When an annular cooling device is used as the cooling device 25, the spinneret discharge holes 16 may be arrayed in an annular form over one column or a plurality of columns, and for a cooling device that blows out an air flow in one direction, the spinneret discharge holes 16 may be arrayed in a lattice or zigzag alignment. A cross section of the spinneret discharge hole 16 in the direction perpendicular to the direction of the polymer spinning path is not limited to a circular shape, and may be either a cross section other than the circular shape or a hollow cross section. Incidentally, when a cross section other than a circular shape is employed, it is preferable to make the length of the spinneret discharge hole 16 larger in order to ensure the polymer metering capability. In addition, also regarding the other-component discharge hole 1 and the sea-component discharge hole 2, the cross section in a direction perpendicular to the direction of the polymer spinning path is not limited to a circular shape, and may be either a cross section other than the circular shape or a hollow cross section.

In the joining hole 17 in the present invention, it is preferable to set the taper angle $\alpha$ of the flow passage extending from the discharge face 23 of the discharge plate 4 to the spinneret discharge hole 16 of the spinneret discharge plate 5 to a range of 50 to 120°. As a result, it is possible to inhibit unstable phenomena such as draw resonance of the composite polymer stream and supply the composite polymer stream more stably. Here, by setting the taper angle $\alpha$ to 50° or more, it is possible to prevent the composite spinneret 13 from having a larger size while inhibiting the unstable phenomenon of the composite polymer stream. By setting the taper angle $\alpha$ to 120° or less, the unstable phenomenon of the composite polymer stream can be more reliably prevented. In addition, it is preferable that the diameter of the joining hole 17 facing the discharge face 23 of the discharge plate 4 be larger than the outer diameter of an imaginary circle surrounding all the discharge hole groups of the other-component discharge holes 1 and the sea-component discharge holes 2 located on the discharge face 23, and the ratio of the cross-sectional area of the imaginary circle to the cross-sectional area of the discharge hole group be as small as possible. Thereby, the expansion of the width of each polymer discharged out of the discharge face 23 is inhibited, and the composite polymer stream can be further stabilized.

In the present invention, only a distribution hole 7 or only a distribution groove 8 may be disposed at one distribution plate 3. Further, the distribution plate 3 may be a distribution plate 3 in which the distribution hole 7 is disposed at an upstream portion and the distribution groove 8 is disposed at a downstream portion in communication with the distribution hole 7, or may be a distribution plate 3 in which the distribution groove 8 is disposed at an upstream portion and the distribution hole 7 is disposed at a downstream portion in communication with the distribution groove 8.

In the present invention, by reducing the interval between the other-component discharge holes 1 of the discharge plate 4, the other-component polymers (island-component polymers) discharged out of adjacent other-component discharge holes 1 are readily joined without being disturbed by the sea-component polymer, and the formability of the island-shaped cross section can be improved. In addition, when the interval between the sea-component discharge holes 2 of the discharge plate 4 is reduced, the sea-component polymers discharged out of adjacent sea-component discharge holes 2 are readily joined without being disturbed by the other-component polymer, and the sea-component polymer can be precisely controlled.

Next, a method for producing a composite fiber common to the embodiments of the present invention will be described in detail with reference to FIGS. 1 to 3 and 7 to 11.

The method for producing a composite fiber of the present invention can be carried out, for example, by using the composite spinneret 13 in a publicly known composite spinning machine. For example, in the case of melt spinning, the spinning temperature is a temperature at which mainly a polymer having a higher melting point or a higher viscosity among two or more polymers exhibits fluidity. Although the temperature at which the polymer exhibits fluidity varies depending on the molecular weight, the melting point of the polymer can serve as a basis, and the temperature may be set at a temperature equal to or lower than (melting point+60° C.). A temperature of (melting point+60° C.) or lower is preferable because the polymer is not thermally decomposed in a spin block 12 or a spin pack 21, and the reduction in molecular weight is inhibited. The spinning speed varies depending on the physical properties of the polymer and the purpose of the composite fiber, but is about 1 to 6000 m/min.

In the present invention, it is preferable to control the discharge rate ratio of the polymers of the respective components discharged out of the other-component discharge holes 1 and the sea-component discharge holes 2 according to the discharge amount, the hole diameter and the number of holes. Here, the discharge rate refers to a value obtained by dividing the discharge flow rate by the cross-sectional area of the other-component discharge hole 1 or the sea-component discharge hole 2. Where the discharge rate of the other-component polymer per hole is denoted by Va and the discharge rate of the sea-component polymer per hole is denoted by Vb, the ratio of these discharge rates (Va/Vb or Vb/Va) is preferably from 0.05 to 20, and more preferably in the range of from 0.1 to 10. Within such a range, each polymer discharged from the discharge plate 4 is stabilized, and the cross section shape can be accurately maintained.

Next, the composite fiber obtained by the production method of the present invention means a fiber in which two or more types of polymers are combined, and refers to a fiber in which two or more types of polymers exist in various island-shaped forms in a cross section of the fiber. Here, it goes without saying that the two or more types of polymers referred to in the present invention include use of two or more types of polymers having different molecular structures, such as polyester, polyamide, polyphenylene sulfide, polyolefin, polyethylene, and polypropylene. Unless spinning stability or the like is impaired, various functional particles such as a matting agent such as titanium dioxide, silicon oxide, kaolin, an anti-coloring agent, a stabilizer, an antioxidant, a deodorant, a flame retardant, a yarn friction reducer, a coloring pigment, and a surface modifier, and particles of an organic compound or the like may be added. A plurality of types of them may be used in different addition amounts, or a plurality of types differing in molecular weight may be used. Those subjected to copolymerization or the like may be used.

A single yarn cross section of the composite fiber obtained by the production method of the present invention may be not only a circular shape but also a shape other than a circular shape such as a triangular shape or a flat shape, or may be a hollow shape. Further, the present invention is an extremely versatile invention, and it is not particularly limited by a single yarn fineness or the number of single yarns of a composite fiber. Furthermore, the present invention is not particularly limited by the number of yarn lines of a composite fiber, and may be one yarn line or two or more multiple yarn lines.

Furthermore, the composite fiber obtained by the present invention refers to a fiber in which two or more different polymers form various island shapes in a cross section perpendicular to the fiber axis direction as described above. In that case, the island shape is not limited, and one island shape may be formed as illustrated in FIG. 4(*a*), or a plurality of island forms may be formed as illustrated in FIGS. 4(*b*), 4(*c*), and 4(*d*). Regarding the number of the island shape, the island shape can be theoretically made infinitely as long as being allowed by the space of the discharge face 23, but the number of the island shape is preferably in a range of 2 to 10,000 as a substantially practicable range. A range where the superiority of the method for producing a composite fiber of the present invention is attained is more preferably 100 to 10000 islands.

In the present invention, the hole packing density (value obtained by dividing the number of the other-component discharge holes 1 for discharging the other-component polymer by the maximum area of the joining hole 17) is preferably 0.1 holes/mm$^2$ or more. As the value of the hole packing density is larger, it is meant that the number of island shapes of a composite fiber is larger and a composite fiber having a cross section with a more complicated island shape can be obtained. However, when the hole packing density is 0.1 holes/mm$^2$ or more, the difference from the conventional composite spinneret technology is clearer. From the viewpoint of a realistic possibility of implementation, the hole packing density is more preferably in a range of 1 to 20 holes/mm$^2$.

The present invention is not limited to the application to a melt spinning method, and can also be applied to a wet spinning method, a dry-wet spinning method, and a dry spinning method. In the case of applying the present invention to the wet spinning method, the composite spinneret 13 is immersed in a coagulation bath, and in the case of applying the present invention to the dry spinning method, the composite spinneret 13 is installed above the liquid surface of a coagulation bath.

In the method for producing a composite fiber of the present invention, since the cross section shape of an island component can be arbitrarily controlled as described above, a free shape can be prepared without being limited to the above-mentioned shapes. The composite fiber to be obtained by the present invention can be formed into various fiber products such as fiber take-up packages, tows, cut fibers, cotton, fiber balls, cords, piles, textiles, nonwoven fabrics, paper and liquid dispersions.

EXAMPLES

Hereinafter, effects of the method for producing a composite fiber of the present invention will be more specifically described with reference to examples. In each example and each comparative example, a composite fiber was spun using a composite spinneret to be described later, and the presence or absence of joining of other-component polymers and the presence or absence of a cross section defect of the composite fiber were determined as follows.

The drawings (FIGS. 7, 9, and 10) used for describing the discharge holes of a discharge face of a composite spinneret each show an image of hole arrangement, and the number of the holes may be different from those used in examples and comparative examples.

(1) Presence or Absence of Joining of Other-Component Polymer

Continuously spinning was performed for 24 hours from the start of the spinning, and then the composite fiber obtained was cut at an arbitrary position in the fiber axis direction, and the fiber cross section was photographed at a magnification of 3000 times with a VE-7800 scanning electron microscope (SEM) manufactured by KEYENCE CORPORATION. The number of islands in the composite fiber was measured, and when the value obtained by dividing the number of the islands by the number of hole groups of other-component discharge holes on the discharge face of the discharge plate was 1, the other-component polymer (island-component polymer) was determined as not joining among different hole groups, and when the value was less than 1, the other-component polymer was determined as joining among different hole groups. When the sea-component discharge holes and the other-component discharge holes are arranged in the same positional relationship among hole groups in the composite spinneret, the composite fiber obtained from one hole group may be observed.

(2) Presence or Absence of Cross Section Defect of Other-Component Polymer

Continuously spinning was performed for 24 hours from the start of the spinning, and then the composite fiber obtained was cut at an arbitrary position in the fiber axis direction, and the fiber cross section was photographed at a magnification of 3000 times with a VE-7800 scanning electron microscope (SEM) manufactured by KEYENCE CORPORATION. When the island shape of the composite fiber of the composite fiber was similar to the shape formed by the hole group of the other-component discharge holes in the discharge face of the discharge plate (the shape of an outline surrounding the hole group), it was determined that there was no cross section defect, and when the island shape was not similar to the shape of the outline surrounding the hole group, it was determined that there was a cross section defect. When the sea-component discharge holes and the other-component discharge holes are arranged in the same positional relationship among hole groups in the composite spinneret, the composite fiber obtained from one hole group may be observed.

(3) Melt Viscosity of Polymer

A polymer in a chip form was caused to have a moisture content of 200 ppm or less with a vacuum dryer, and the melt viscosity was measured with "Capilograph 1B" manufactured by Toyo Seiki Seisaku-sho, Ltd. while changing the strain rate stepwise. The measurement temperature was the same as the spinning temperature, and the melt viscosity at 1216 s$^{-1}$ is described in examples or comparative examples. Incidentally, the measurement was started at 5 minutes after charging a sample into a heating furnace, and it was performed in a nitrogen atmosphere.

Example 1

Polyethylene terephthalate (PET) having a limiting viscosity [η] of 0.65 as the other-component polymer and polyethylene terephthalate (PET) having a limiting viscosity [η] of 0.59 as the sea-component polymer were separately melted at 285° C. These melted polymers were fed to an apparatus illustrate in FIG. 1 equipped with the following composite spinneret 13, and were discharged at a discharge ratio of other-component polymer/sea-component polymer of 30/70. The discharged polymer was cooled with the cooling device 25, and then subjected to oil feeding, entangling treatment, and thermal stretching, and wound at a speed of 1500 m/min by a winding roller, and thus an unstretched fiber of 150 dtex-10 filaments (discharge amount per hole: 2.25 g/min) was obtained. The wound unstretched fiber was stretched 2.5 times between rollers heated to 90° C. and 130° C., and thus a composite fiber of 60 dtex-10 filaments was obtained.

As shown in FIG. 7, on the discharge face 23 of the discharge plate 4 of the composite spinneret 13, in one hole group, 65 other-component discharge holes 1 were arrayed radially and 526 sea-component discharge holes 2 were arrayed, while 380 sea-component discharge holes 2 were located in the region inside the imaginary circle 14 and 146 sea-component discharge holes 2 were located on the outer mold of the imaginary circle 14.

In the spinning test, there was no fiber cross section defect.

Example 2

A composite fiber in which a plurality of cross-shaped islands was arrayed was obtained using the same polymer and spinning conditions as in Example 1 except that the composite spinneret 13 was different.

As shown in FIG. 9, on the discharge face 23 of the discharge plate 4 of the composite spinneret 13, in one hole group, 243 other-component discharge holes 1 and 3840 sea-component discharge holes 2 were arrayed, 2560 sea-component discharge holes 2 were located in the region inside the imaginary circle 14, and 1280 sea-component discharge holes 2 were located on the outer mold of the imaginary circle 14.

In the spinning test, there was no joining of the other-component polymer, and there was no fiber cross section defect.

Example 3

Polyethylene terephthalate (PET) having an intrinsic viscosity [η] of 0.65 as a first component of the other-component polymer (hereinafter, referred to as first other-component polymer), polyethylene terephthalate (PET) having an intrinsic viscosity [η] of 0.59 as a sea-component polymer, and PET copolymerized with 5.0 mol % of 5-sodium-sulfoisophthalic acid (copolymerized PET) having an intrinsic viscosity [η] of 0.58 as a second component of the other-component polymer (hereinafter, referred to as second other-component polymer) were separately melted at 285° C. These melted polymers were fed to an apparatus illustrate in FIG. 1 equipped with the following composite spinneret 13, and were discharged at a discharge ratio of first other-component polymer/second other-component polymer/sea-component polymer of 30/10/60. Using the same spinning conditions as in Example 1 except the above-described discharge condition, a composite fiber in which a plurality of islands having a core-clad structure (the core was the first other-component polymer, and the clad was the second other-component polymer) were arrayed was obtained.

As shown in FIG. 10, on the discharge face 23 of the discharge plate 4 of the composite spinneret 13, in one hole group, 44 first other-component discharge holes 1', 353 second other-component discharge holes 1", and 2790 sea-component discharge holes 2 were arrayed, 2500 sea-component discharge holes 2 were located in the region inside the imaginary circle 14, and 290 sea-component discharge holes 2 were located on the outer mold of the imaginary circle 14.

In the spinning test, there was no joining of the other-component polymer, and there was no fiber cross section defect.

Example 4 and Example 5

Using the same polymer and spinning conditions as in Example 3 except that the composite spinneret 13 was changed to that described below and the entire discharge amount ratio of the sea-component polymer was adjusted to be as shown in Table 1, composite fibers in which a plurality of islands having a core-clad structure (the core was the first other-component polymer, and the clad was the second other-component polymer) were arrayed were obtained.

As shown in FIG. 10, on the discharge face 23 of the composite spinneret 13, in one hole group, 44 first other-component discharge holes 11', 353 second other-component discharge holes 1", and 2790 sea-component discharge holes 2 were arrayed, 2270 sea-component discharge holes 2 were located in the region inside the imaginary circle 14, and 520 sea-component discharge holes 2 were located on the outer mold of the imaginary circle 14.

In both Examples 4 and 5, there was no joining of the other-component polymer, and there was no fiber cross section defect. However, although both the island shapes were similar to the shape of the outline surrounding the hole group of the second other-component discharge holes 1", in Example 5, the island shape having the core-clad structure was slightly deformed into an elliptical shape as compared with Example 4.

Example 6 and Example 7

Using the same polymer and spinning conditions as in Example 2 except that the composite spinneret 13 was changed to that described below and the entire discharge amount ratio of the sea-component polymer was adjusted to be as shown in Table 1, composite fibers in which a plurality of cross-shaped islands were arrayed were obtained.

In both Examples 6 and 7, as illustrated in FIG. 9, 243 other-component discharge holes 1 and 3840 sea-component discharge holes 2 were arrayed in one hole group on the discharge face 23 of the composite spinneret 13. However, in Example 6, 3400 sea-component discharge holes 2 were located in the region inside the imaginary circle 14, and 440 sea-component discharge holes 2 were located on the outer mold of the imaginary circle 14, whereas in Example 7, 3600 sea-component discharge holes 2 were located in the region inside the imaginary circle 14, and 240 sea-component discharge holes 2 were located on the outer mold of the imaginary circle 14.

In both Examples 6 and 7, there was no joining of the other-component polymer, and there was no fiber cross section defect. However, although both the island shapes were similar to the shape of the outline surrounding the hole group of the other-component discharge holes 1, in Example 7, the island shapes located at the outer peripheral portion of the composite fiber were slightly deformed as compared with Example 6.

Comparative Example 1

Spinning was performed with the same polymer, same fineness, and same spinning conditions as in Example 1 using the same composite spinneret 13 as that in Example 1 except having the discharge face 23 as illustrated in FIG. 6.

As shown in FIG. 6, on the discharge face 23, in one hole group, 65 other-component discharge holes 1 were arrayed radially and 526 sea-component discharge holes 2 were arrayed, while 421 sea-component discharge holes 2 were located in the region inside the imaginary circle 14, and 105 sea-component discharge holes 2 were located on the outer mold of the imaginary circle 14.

In the spinning test, there was a fiber cross section defect. Specifically, the composite fiber obtained had, in a cross section, a portion in which tips of the other-component polymer linear body were thickened as illustrated in FIG. 5 or a part of a tip of the other-component polymer linear body was not covered with the sea-component polymer.

Comparative Example 2

A composite fiber in which a plurality of cross-shaped islands was arrayed was spun with the same polymer, same fineness, and same spinning conditions as in Example 2 using the same composite spinneret 13 as that in Example 2 except having the discharge face 23 described below.

On the discharge face 23, in one hole group, 243 other-component discharge holes 1 and 3840 sea-component discharge holes 2 were arrayed, 1920 sea-component discharge holes 2 were located in the region inside the imaginary circle 14, and 1920 sea-component discharge holes 2 were located on the outer mold of the imaginary circle 14.

In the spinning test, there was joining of the other-component polymer, and there was a defect in fiber cross section in which the island shapes were partially not in a cross-shaped. Specifically, the other-component polymer linear bodies discharged out of adjacent hole groups partially joined, or the cross-shaped island was distorted into an oblate form, or furthermore, the lengths of the four-side linear bodies constituting the cruciform island shape were non-uniform.

The results of the respective examples and comparative examples are summarized in Tables 1 and 2.

TABLE 1

| | Example 1 | Example 2 | Example 3 | Comparative Example 1 | Comparative Example 2 |
|---|---|---|---|---|---|
| Entire discharge amount $Q_{out}$ of sea-component polymer discharged from all sea-component discharge holes located in the region outside the imaginary circle/ Entire discharge amount $Q_{in}$ of sea-component polymer discharged from all sea-component discharge holes located in the region inside the imaginary circle | 0.6 | 1.0 | 3.7 | 0.2 | 0.4 |
| Sum total $S_{in}$ of hole areas of all sea-component discharge holes located in the region inside the imaginary circle/ Sum total $S_{out}$ of hole areas of all sea-component discharge located in the region outside the imaginary circle | 0.5 | 0.6 | 0.9 | 0.3 | 0.4 |
| Hole area $Sa_{out}$ of one sea-component discharge hole located in the region outside the imaginary circle/ Hole area $Sa_{in}$ of one sea-component discharge located in the region inside the imaginary circle | 3.0 | 1.7 | 1.1 | 0.8 | 0.7 |
| Discharge amount $Qa_{out}$ of sea-component polymer discharged from one sea-component discharge hole located in the region outside the imaginary circle/ Discharge amount $Qa_{in}$ of sea-component polymer discharged from one sea-component discharge hole located in the region inside the imaginary circle | 1.6 | 2.0 | 32.0 | 0.8 | 0.4 |
| Presence or absence of joining of other-component polymer | — | Absent | Absent | — | Present |
| Presence or absence of cross section defect | Absent | Absent | Absent | Present | Present |

TABLE 2

| | Example 4 | Example 5 | Example 6 | Example 7 |
|---|---|---|---|---|
| Entire discharge amount $Q_{out}$ of sea-component polymer discharged from all sea-component discharge holes located in the region outside the imaginary circle/ Entire discharge amount $Q_{in}$ of sea-component polymer discharged from all sea-component discharge holes located in the region inside the imaginary circle | 7.4 | 8.7 | 1.0 | 0.6 |
| Sum total $S_{in}$ of hole areas of all sea-component discharge holes located in the region inside the imaginary circle/ Sum total $S_{out}$ of hole areas of all sea-component discharge located in the region outside the imaginary circle | 0.8 | 0.8 | 2.8 | 3.3 |
| Hole area $Sa_{out}$ of one sea-component discharge hole located in the region outside the imaginary circle/ Hole area $Sa_{in}$ of one sea-component discharge located in the region inside the imaginary circle | 1.1 | 1.1 | 1.1 | 1.1 |
| Discharge amount $Qa_{out}$ of sea-component polymer discharged from one sea-component discharge hole located in the region outside the imaginary circle/ | 32.0 | 38.0 | 8.0 | 8.0 |

TABLE 2-continued

| | Example 4 | Example 5 | Example 6 | Example 7 |
|---|---|---|---|---|
| Discharge amount $Qa_{in}$ of sea-component polymer discharged from one sea-component discharge hole located in the region inside the imaginary circle | | | | |
| Presence or absence of joining of other-component polymer | Absent | Absent | Absent | Absent |
| Presence or absence of cross section defect | Absent | Absent | Absent | Absent |

INDUSTRIAL APPLICABILITY

The present invention can be applied not only to a method for producing a composite fiber to be used in a general solution spinning method but also to methods for producing a composite fiber to be used in a wet spinning method or a dry-wet spinning method, but the application range is not limited thereto.

DESCRIPTION OF REFERENCE SIGNS

1, 1', 1": Other-component discharge hole
2: Sea-component discharge hole
3: Distribution plate
4: Discharge plate
5: Spinneret discharge plate
6: Distribution hole
7: Distribution groove
8: Discharge hole
9: Other-component polymer (A)
10: Other-component polymer (B)
11: Sea-component polymer (C)
12: Spin block
13: Composite spinneret
14: Imaginary circle
15: Composite polymer
16: Spinneret discharge hole
17: Joining hole
18: Other-component polymer (A)
19: Other-component polymer (B)
20: Sea-component polymer (C)
21: Spin pack
22: Composite fiber
23: Discharge face
24: Second imaginary circle
25: Cooling device
$S_{in}$: Sum total of hole areas of all sea-component discharge holes located in region inside imaginary circle
$S_{out}$: Sum total of hole areas of all sea-component discharge holes located in region outside imaginary circle

The invention claimed is:

1. A method for producing a composite fiber, the method comprising:

distributing a sea-component polymer and at least one other-component polymer different from the sea-component polymer by a distribution plate;

discharging the sea-component polymer and the other-component polymer distributed by the distribution plate respectively from sea-component discharge holes and other-component discharge holes of a discharge plate positioned at a downstream side of the distribution plate with respect to a polymer spinning path direction, thereby forming at least one composite polymer; and discharging the composite polymer from a discharge hole of a spinneret discharge plate positioned at a downstream side of the discharge plate with respect to the polymer spinning path direction, wherein in a discharge face of the discharge plate, corresponding to the one composite polymer, there is at least one hole group in which a plurality of the sea-component discharge holes is located to surround one or a plurality of the other-component discharge holes, and in the one hole group, where a circle with a minimum diameter including all the other-component discharge holes thereinside is defined as an imaginary circle, an entire discharge amount $Q_{out}$ of the sea-component polymer discharged from all sea-component discharge holes located in a region outside the imaginary circle and an entire discharge amount $Q_{in}$ of the sea-component polymer discharged from all sea-component discharge holes located in a region inside the imaginary circle satisfy $Q_{out}/Q_{in} \geq 0.5$.

2. The method for producing a composite fiber according to claim 1, wherein in the one hole group, a sum total $S_{in}$ of hole areas of all the sea-component discharge holes located in the region inside the imaginary circle and a sum total $S_{out}$ of hole areas of all the sea-component discharge located in the region outside the imaginary circle satisfy $S_{in}/S_{out} \geq 0.5$.

3. The method for producing a composite fiber according to claim 1, wherein in the one hole group, a hole area of one sea-component discharge holes located in the region outside the imaginary circle is larger than a hole area of one sea-component discharge located in the region inside the imaginary circle.

4. The method for producing a composite fiber according to claim 1, wherein in the one hole group, a discharge amount of the sea-component polymer discharged from one sea-component discharge holes located in the region outside the imaginary circle is larger than a discharge amount of the sea-component polymer discharged from one sea-component discharge holes located in the region inside the imaginary circle.

5. A composite spinneret for discharging at least one composite polymer stream composed of a sea-component polymer and at least one type of other-component polymer different from the sea-component polymer, the composite spinneret comprising:

a distribution plate for distributing the sea-component polymer and the other-component polymer;

a discharge plate which is positioned at a downstream side of the distribution plate with respect to a polymer spinning path direction and which is provided with sea-component discharge holes for discharging the sea-component polymer and other-component discharge holes for discharging the other-component polymer; and a spinneret discharge plate which is positioned at a downstream side of the discharge plate with respect to a polymer spinning path direction and which is provided with a discharge hole for discharging the composite polymer, wherein in a discharge face of the discharge plate, corresponding to the one composite polymer stream, there is at least one hole group in which a plurality of the sea-component discharge holes is located to surround one or a plurality of the other-component discharge holes, and in the one hole group, where a circle with a minimum diameter including all the other-component discharge holes thereinside is defined as an imaginary circle, a hole area of one sea-component discharge holes located in a region outside the imaginary circle is larger than a hole area of one sea-component discharge holes located in a region inside the imaginary circle.

* * * * *